US012214990B2

(12) United States Patent
Nakano

(10) Patent No.: US 12,214,990 B2
(45) Date of Patent: Feb. 4, 2025

(54) SHEET FEEDING APPARATUS AND IMAGE FORMING APPARATUS

(71) Applicant: Takashi Nakano, Kanagawa (JP)

(72) Inventor: Takashi Nakano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 179 days.

(21) Appl. No.: 18/058,950

(22) Filed: Nov. 28, 2022

(65) Prior Publication Data

US 2023/0192429 A1 Jun. 22, 2023

(30) Foreign Application Priority Data

Dec. 20, 2021 (JP) ..... 2021-206044

(51) Int. Cl.
*B65H 7/14* (2006.01)
*B65H 1/14* (2006.01)
*B65H 3/08* (2006.01)

(52) U.S. Cl.
CPC ..... *B65H 7/14* (2013.01); *B65H 1/14* (2013.01); *B65H 3/08* (2013.01); *B65H 2553/40* (2013.01)

(58) Field of Classification Search
CPC ..... B65H 3/08; B65H 3/14; B65H 3/0808; B65H 3/0816; B65H 3/44; B65H 3/48; B65H 3/128; B65H 7/02; B65H 7/04; B65H 7/14; B65H 1/14; B65H 2553/40; B65H 2511/13; B65H 2511/15; B65H 2511/30; B65H 2511/414; B65H 2511/415; B65H 2511/416; B65H 2511/515; B65H 2801/06
USPC ..... 271/11, 12, 90, 97, 98
See application file for complete search history.

(56) References Cited

U.S. PATENT DOCUMENTS

| | | | | |
|---|---|---|---|---|
| 10,662,009 | B2 * | 5/2020 | Hashimoto | B65H 3/14 |
| 10,787,329 | B2 * | 9/2020 | Sugawara | B65H 5/062 |
| 2007/0096387 | A1 * | 5/2007 | Sciurba | B65H 3/44 271/152 |
| 2014/0084531 | A1 | 3/2014 | Fukumoto et al. | |
| 2015/0048566 | A1 | 2/2015 | Utagawa et al. | |
| 2015/0145199 | A1 | 5/2015 | Yoshida et al. | |
| 2021/0163246 | A1 | 6/2021 | Nakano et al. | |

(Continued)

FOREIGN PATENT DOCUMENTS

| | | |
|---|---|---|
| JP | 61-106352 | 5/1986 |
| JP | 9-301574 | 11/1997 |
| JP | 10316262 A * | 12/1998 |

(Continued)

*Primary Examiner* — Leslie A Nicholson, III
(74) *Attorney, Agent, or Firm* — IPUSA, PLLC

(57) ABSTRACT

A sheet feeding apparatus includes a first feeder, a second feeder, and processing circuitry. The first feeder includes a sheet stacker, an air blower, a suction feeder, and a remaining amount detection sensor. The air blower blows air to float an uppermost sheet. The suction feeder sucks and feeds the sheet. The remaining amount detection sensor detects a remaining amount of sheets stacked. The processing circuitry determines whether the remaining amount of sheets in the first feeder is smaller than a threshold, causes the first feeder to perform a feeding operation of feeding the sheet floated by the air blower to the suction feeder in response to a determination that the remaining amount is equal to or greater than the threshold, and causes the second feeder to feed a sheet instead of the first feeder in response to a determination that the remaining amount is smaller than the threshold.

7 Claims, 11 Drawing Sheets

(56) References Cited

U.S. PATENT DOCUMENTS

2021/0292118 A1 9/2021 Fukasawa et al.

FOREIGN PATENT DOCUMENTS

JP 2001302003 A * 10/2001
JP 2003-327337 11/2003

* cited by examiner

SHEET FEEDING APPARATUS AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2021-206044, filed on Dec. 20, 2021, in the Japan Patent Office, the entire disclosure of which is hereby incorporated by reference herein.

BACKGROUND

Technical Field

Embodiments of the present disclosure relate to a sheet feeding apparatus and an image forming apparatus.

Related Art

A sheet feeding apparatus is known that includes a sheet stacker, an air blower, and a suction feeder, Multiple sheets are stacked on the sheet stacker in a stacked state. The air blower blows air to the multiple sheets stacked on the sheet stacker from a lateral side of the sheets to float an uppermost sheet of the sheets. The suction feeder is disposed above the sheet stacker and attracts the sheet floated by the air blower to feed the sheet in a feed direction.

The above-described sheet feeding apparatus further includes a lifting mechanism that lifts and lowers the sheet stacker so that air from the air blower hits the uppermost sheet stacked on the sheet stacker. However, when the sheet stacker is lifted excessively, the sheet stacker may block the air from the air blower.

On the other hand, in a sheet feeding apparatus including multiple sheet feed ports, a technology is known that switches to a second sheet feed port different from a first sheet feed port to continue sheet feeding when an abnormality occurs in a sheet feeding operation of the first sheet feed port.

SUMMARY

In an embodiment of the present disclosure, a sheet feeding apparatus includes a first feeder, a second feeder, and processing circuitry. The first feeder Boats and feeds a sheet. The second feeder feeds a sheet. The processing circuitry causes the first feeder and the second feeder to feed a sheet. The first feeder includes a sheet stacker, an air blower, a suction feeder, and a remaining amount detection sensor. A plurality of sheets are stacked in a stacked state on the sheet stacker. The air blower blows air from a lateral side of the plurality of sheets stacked on the sheet stacker to float an uppermost sheet. The suction feeder above the sheet stacker sucks a sheet floated by the air blower and feeds the sheet in a feed direction. The remaining amount detection sensor detects a remaining amount of sheets stacked on the sheet stacker. The processing circuitry determines whether the remaining amount of sheets in the first feeder is smaller than a threshold, causes the first feeder to perform a feeding operation of feeding the sheet floated by the air blower to the suction feeder in response to a determination that the remaining amount of sheets is equal to or greater than the threshold, and causes the second feeder to feed a sheet instead of the first feeder in response to a determination that the remaining amount of sheets is smaller than the threshold.

In another embodiment of the present disclosure, an image forming apparatus includes the sheet feeding apparatus and an image forming device to form an image on a sheet fed by the sheet feeding apparatus.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
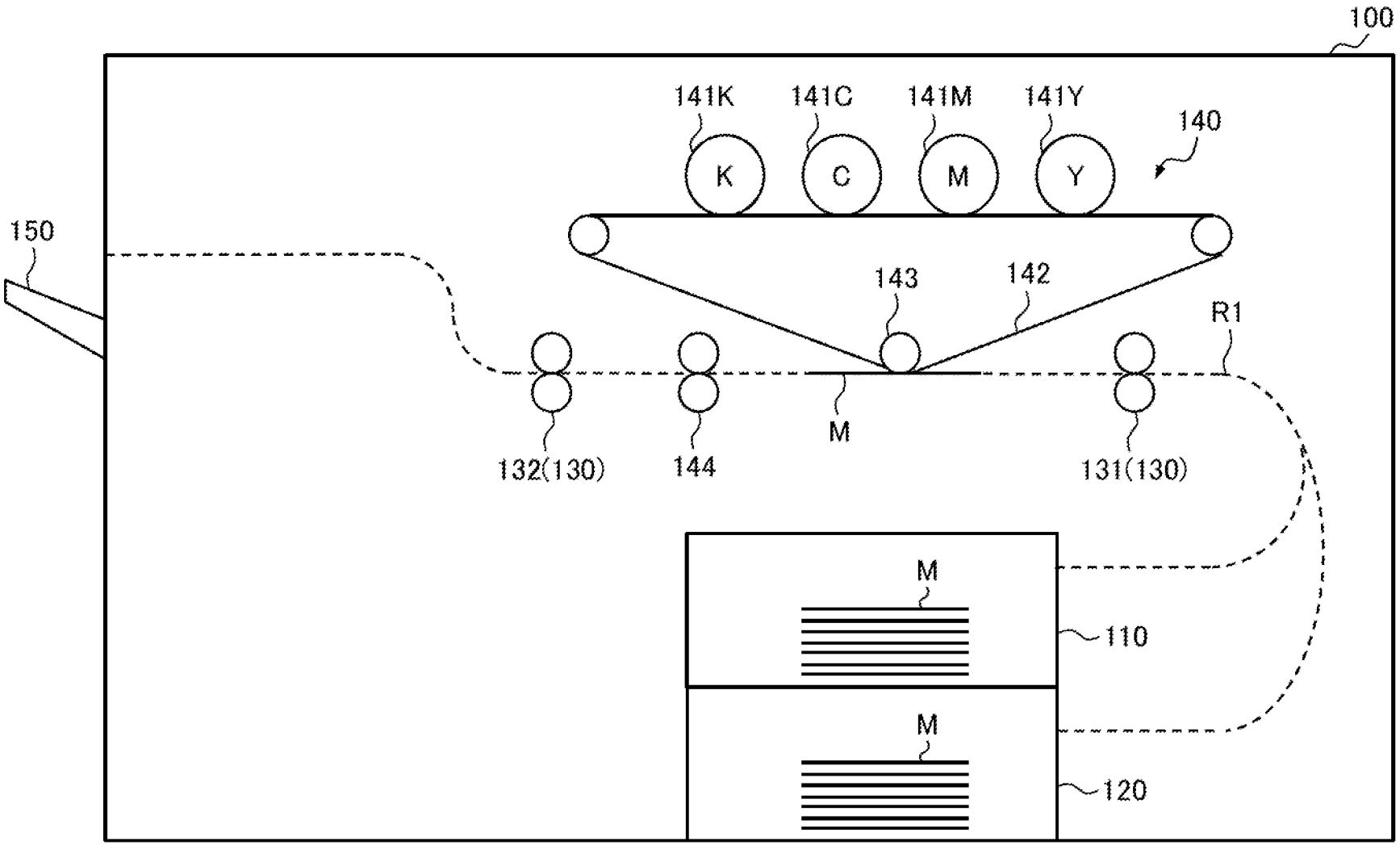
FIG. 1 is a schematic diagram illustrating an internal configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

Embodiments of the present disclosure are described below with reference to the attached drawings. FIG. 1 is a schematic diagram illustrating an internal configuration of an image forming apparatus 100 according to an embodiment of the present disclosure. As illustrated in FIG. 1, the image forming apparatus 100 typically includes a first feeder 110 and a second feeder 120, which may be collectively referred to as feeders 110 and 120 in the following description, a conveyor 130, an image forming device 140, and an output tray 150. In the feeders 110 and 120, multiple sheets M on which no images are formed yet are stacked and stored. The sheet M on which an image has been formed is stored in the output tray 150.

The sheet M is an example of a sheet that is fed from the first feeder 110 or the second feeder 120, conveyed by the conveyor 130, and on which an image is formed by the image forming device 140. However, the sheet M is not limited to a sheet of paper, and may be, for example, an overhead projector (OHP) sheet, or cloth. A conveyance path R1 that is a space in which the sheet M is conveyed is formed inside the image forming apparatus 100. The conveyance path R1 is a path extending from the feeders 110 and 120 to the output tray 150 via a position facing the image forming device 140.

Each of the feeders 110 and 120 stacks and stores multiple sheets M and supplies and feeds the stacked sheets M one by one to the conveyor 130. More specifically, each of the feeders 110 and 120 floats and feeds an uppermost sheet M of the stacked sheets M. A detailed configuration of the feeders 110 and 120 will be described below with reference to FIGS. 2 and 3.

The conveyor 130 conveys a sheet M fed from the feeders 110 and 120 in the conveyance path R1. Specifically, the conveyor 130 conveys the sheet M stored in the feeders 110 and 120 to the position facing the image forming device 140 in the conveyance path R1. The conveyor 130 ejects the sheet M on a surface of which an image has been formed by the image forming device 140 to the output tray 150 in the conveyance path R1.

The conveyor 130 includes multiple conveyance roller pairs 131 and 132. Each of the conveyance roller pairs 131 and 132 includes, for example, a driving roller to which a driving force of a motor is transmitted to rotate, and a driven roller that contacts the driving roller to be driven to rotate. The driving rollers and the driven rollers rotate while nipping the sheet M to convey the sheet M in the conveyance path R1.

The conveyance roller pair 131 is disposed upstream from the image forming device 140 in the conveyance direction. The conveyance roller pair 132 is disposed downstream from the image forming device 140 in the conveyance direction. However, positions at which the conveyance roller pair 131 and the conveyance roller pair 132 are disposed are not limited to the two positions illustrated in FIG. 1.

The image forming device 140 is disposed between the conveyance roller pair 131 and the conveyance roller pair 132 to face the conveyance path R1. The image forming device 140 forms an image on the surface of a sheet M conveyed by the conveyor 130. The image forming device 140 according to the present embodiment forms an image on a sheet M conveyed in the conveyance path R1 by an electrophotogaphic method. However, the image forming method of the image forming device 140 may be an inkjet recording method in which ink is discharged onto the sheet M to form an image.

More specifically, in the image forming device 140, photoconductor drums 141Y, 141M, 141C, and 141K, which are referred to collectively as a photoconductor drum 141 in the following description, for the respective colors are arranged along a transfer belt 142 that is an endless moving conveyor. In other words, the multiple photoconductor drums 141Y, 141M, 141C, and 141K are arranged in order from upstream from the transfer belt 142 in the conveyance direction along the transfer belt 142, on which an intermediate transfer image to be transferred to the sheet M fed from the feeder 110 or the feeder 120 is formed.

Toner contained in a toner bottle is supplied to the photoconductor drum 141. Images of Y, M, C. and K colors developed with corresponding toner on surfaces of the photoconductor drums 141Y, 141M, 141C, and 141K, respectively, are superposed and transferred to the transfer belt 142 to form a full-color image. The fill-color image formed on the transfer belt 142 is transferred to the sheet M by the transfer roller 143 at a position closest to the conveyance path R1.

Further, the image forming device 140 includes a fixing roller pair 144 disposed downstream from the transfer roller 143 in the conveyance direction. The fixing roller pair 144 includes a driving roller that is driven by a motor, and a driven roller that contacts the driving roller to be driven by the driving roller. Then, the driving roller and the driven roller rotate while nipping the sheet M. In this process, the sheet M is heated and pressed to fix the image transferred by the transfer roller 143 onto the sheet M.

Figure 2:
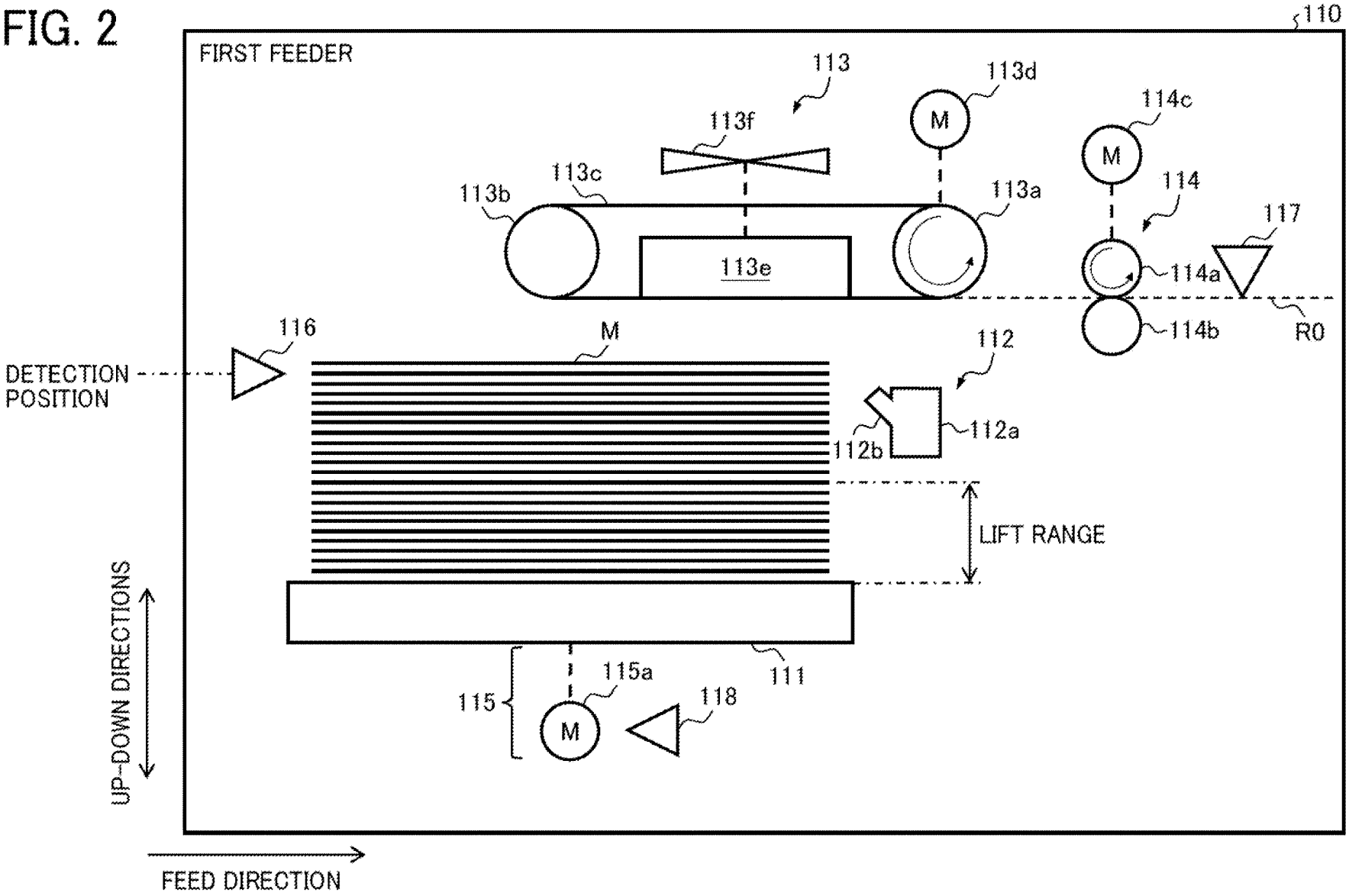
FIG. 2 is a schematic diagram illustrating a configuration of a first feeder according to an embodiment of the present disclosure.

FIG. 2 is a schematic diagram illustrating a configuration of the first feeder 110 according to an embodiment of the present disclosure. FIGS. 3A, 3B, 3C, and 3D are diagrams illustrating an operation of the first feeder 110, according to the present embodiment. The first feeder 110 feeds the sheets M one by one to the conveyance path R1 through a feed path R0. As illustrated in FIG. 2, the first feeder 110 typically includes a sheet stacker 111 as a sheet stacker, an air blower 112, a suction feeder 113, a nip feed roller pair 114, a lifting mechanism 115, a lift detection sensor 116, a feed detection sensor 117, and a remaining amount detection sensor 118.

The sheet stacker 111 is a tray or a cassette on which multiple sheets M can be stacked in a stacked state. Sheets M can be replenished in the sheet stacker 111 by a user. Further, the sheet stacker 111 is supported by a frame of the first feeder 110 to be movable up and down within a predetermined lift range by the lifting mechanism 115.

Figure 3A:
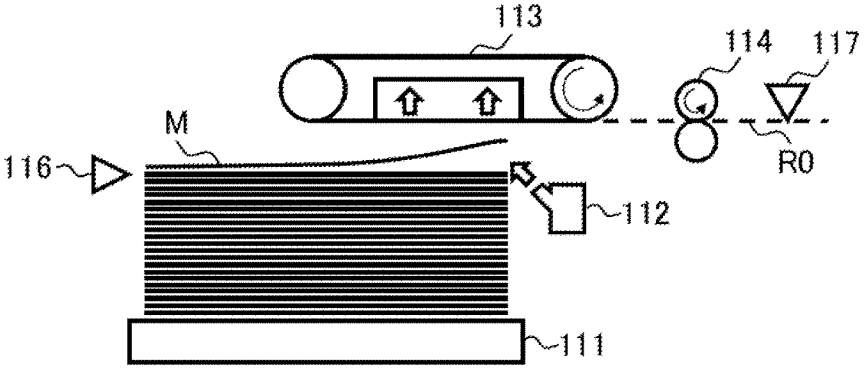
FIGS. 3A, 3B, 3C, and 3D are diagrams illustrating an operation of the first feeder of FIG. 2.

The air blower 112 is disposed above the sheet stacker 111 and below the suction feeder 113. Specifically, the air blower 112 is disposed at a position at which the air blower 112 can face the sheets M stacked on the sheet stacker 111 in the horizontal direction. Then, as illustrated in FIG. 3A, the air blower 112 blows air from a lateral side to the multiple sheets Ni stacked on the sheet stacker 111 to float an uppermost sheet M.

The air blower 112 includes, for example, a float blower 112*a* and a blower port 112*b*. The float blower 112*a* generates air to float the sheets M. The blower port 112*b* blows air generated by the float blower 112*a* obliquely upward toward the sheets M stacked on the sheet stacker 111. Then, the sheet stacker 111 is lifted or lowered by the lifting mechanism 115 so that the uppermost sheet M is positioned on a path of the air blown from the blower port 112*b*. Thus, the uppermost sheet M is floated.

The suction feeder 113 is disposed above the sheet stacker 111, the air blower 112, and the lift detection sensor 116. Further, the suction feeder 113 is disposed upstream from the nip feed roller pair 114 and the feed detection sensor 117 in the feed direction. The suction feeder 113 attracts a sheet M floated by the air blower 112 and conveys the sheet M in the feed direction in the feed path R0. The feed path R0 is connected to the conveyance path R1.

The suction feeder 113 includes, for example, a driving pulley 113*a*, a driven pulley 113*b*, an endless annular belt 113*c*, a feeding motor 113*d*, a suction port 113*e*, and a suction fan 113*f*. The driving pulley 113*a* and the driven pulley 113*b* are rotatably supported at positions spaced apart from each other in the feed direction. The endless annular belt 113*c* is wound around the driving pulley 113*a* and the driven pulley 113*b*. Multiple through-holes are formed on the surface of the endless annular belt 113*c*. The feeding motor 113*d* rotates the driving pulley 113*a*. The suction port 113*e* is disposed inside a loop of the endless annular belt 113*c* and is opened downward. The suction fan 113*f* sucks air below the suction feeder 113 through the suction port 113*e* and the through-holes of the endless annular belt 113*c*.

Figure 3B:
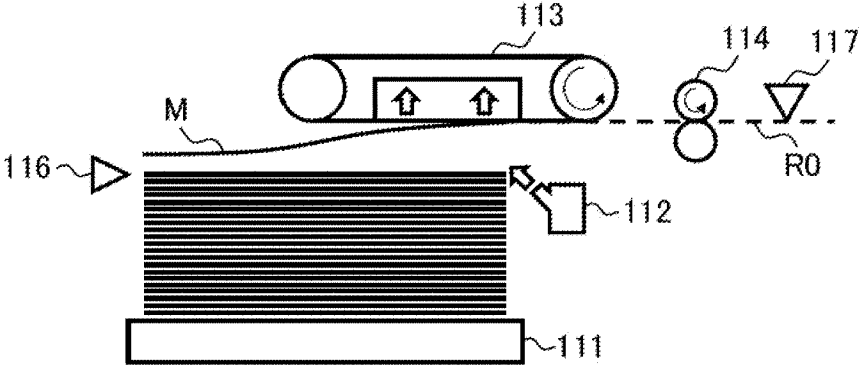
Figure 3C:
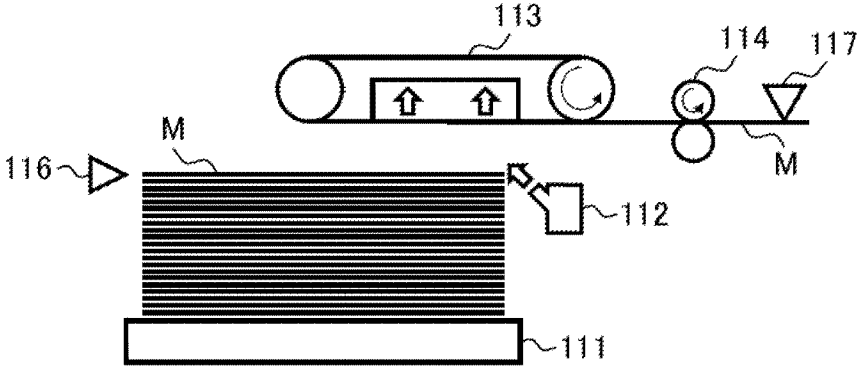

As illustrated in FIG. 3B, the suction fan 113*f* is driven to generate an upward air flow. Accordingly, the sheet M floated by the air blower 112 is attracted to a lower surface of the endless annular belt 113*c*. Further, as illustrated in FIG. 3C, the feeding motor 113*d* is driven to rotate the driving pulley 113*a* (in other words, the endless annular belt 113*c*) counterclockwise. Accordingly, the sheet M attracted to the lower surface of the endless annular belt 113*c* is conveyed in the feed path R0 and supplied to the nip feed roller pair 114.

The nip feed roller pair 114 is disposed downstream from the suction feeder 113 in the feed direction and upstream from the feed detection sensor 117 in the feed direction. The nip feed roller pair 114 feeds the sheet M supplied from the suction feeder 113, in the feed direction in the feed path R0. The nip feed roller pair 114 includes, for example, a driving roller 114*a*, a driven roller 114*b*, and a feeding motor 114*c*.

Each of the driving roller 114*a* and the driven roller 114*b* is rotatably supported. The driving roller 114*a* and the driven roller 114*b* are in contact with each other with the feed path R0 interposed between the driving roller 114*a* and the driven roller 114*b*. The feeding motor 114*c* rotates the driving roller 114*a*. The nip feed roller pair 114 nips and feeds the sheet M, Which has entered between the driving roller 114*a* and the driven roller 114*b*, with the driving roller 114*a* and the driven roller 114*b*. Thus, the sheet M is fed to the conveyance path R1.

Figure 3D:
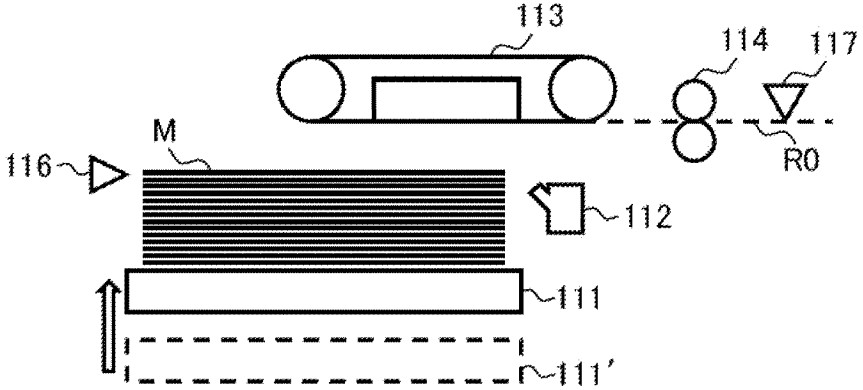

The lifting mechanism 115 lifts or lowers the sheet stacker 111. The lifting mechanism 115 includes, for example, a lifting motor 115*a* and a driving force transmitter that transmits the driving force of the lifting motor 115*a* to the sheet stacker 111. The driving force transmitter may include, for example, a pulley that is rotatably supported, and a belt that is wound around the pulley, with one end of the belt being connected to the sheet stacker 111 and the Other end of the belt being connected to an output shaft of the lifting motor 115*a*. The lifting mechanism 115 causes the lifting motor 115*a* to rotate in a first direction to lift the sheet stacker 111, as illustrated in FIG. 3D. The lifting mechanism 115 rotates the lifting motor 115*a* in a second direction opposite to the first direction to lower the sheet stacker 111.

The lift detection sensor 116 is fixed at a detection position above the sheet stacker 111 and below the suction feeder 113. More specifically, the lift detection sensor 116 is located above the sheet stacker 111 that is located at an upper end of the lift range. Further, the lift detection sensor 116 is disposed at a position at which the lift detection sensor 116 can face the sheets M stacked on the sheet stacker 111 in the horizontal direction. The lift detection sensor 116 detects whether the sheets M stacked on the sheet stacker 111 are present at the detection position. The lift detection sensor 116 determines that the sheets M are present at the detection position, for example, when the density of the sheets M present in a region including the detection position is equal to or higher than a predetermined value.

The lift detection sensor 116 is, for example, a reflection-type optical sensor including a light emitter and a light receiver. The light emitter emits light in a horizontal direction from the detection position. The light receiver receives the light emitted from the light emitter and reflected by the sheets M stacked on the sheet stacker 111. When the light receiver receives the light, the lift detection sensor 116 outputs a presence signal indicating that the sheets M are present at the detection position to a controller 160 to be described later. On the other hand, when the light receiver does not receive the light, the lift detection sensor 116 stops outputting the presence signal to the controller 160.

The feed detection sensor 117 is disposed downstream from the suction feeder 113 and the nip feed roller pair 114 in the feed direction. Further, the feed detection sensor 117 is disposed to face the feed path R0. The feed detection sensor 117 detects whether a sheet M has passed through the feed path R0, in other words, whether the sheet M has been properly fed.

The feed detection sensor 117 is, for example, a reflection type optical sensor including a light emitter and a light receiver. The light emitter emits light toward the feed path R0. The light receiver receives light emitted from the light emitter and reflected by the sheet M that passes through the feed path R0. When the light receiver receives the light, the feed detection sensor 117 outputs, to the controller 160, a feed signal indicating that the sheet M has been fed. On the other hand, when the light receiver does not receive the light, the feed detection sensor 117 stops outputting the feed signal to the controller 160.

The remaining amount detection sensor 118 detects a remaining amount of sheets M stacked on the sheet stacker 111. The remaining amount of sheets M is indicated by, for example, a ratio when a maximum amount of the sheets M, i.e., a maximum number of the sheets M, that can be stacked on the sheet stacker 111 is set to 100%. The remaining amount detection sensor 118 is, for example, a rotary encoder attached to an output shaft of the lifting motor 115*a*. The remaining amount detection sensor 118 outputs a pulse signal corresponding to a rotation amount of the lifting motor 115*a* in the first direction to the controller 160 (see FIG. 4) to be described later. However, a specific configuration of the remaining amount detection sensor 118 is not limited to the above-described example as long as the remaining amount detection sensor 118 can detect the remaining amount of sheets M stacked on the sheet stacker 111.

The configuration of the second feeder 120 according to the present embodiment is similar to the configuration of the first feeder 110. Components common to the first feeder 110 and the second feeder 120 are denoted by reference numerals having a common suffix "x", such as "11x" for the first feeder 110 and "12x" for the second feeder 120. However, the specific configuration of the second feeder 120 is not limited to the above-described example. As another example, the second feeder 120 may feed sheets M by feeding rollers that contact and rotate an uppermost sheet M stacked on the sheet stacker 111. As still another example, the second feeder 120 may feed a sheet M manually fed by a user.

Figure 4:
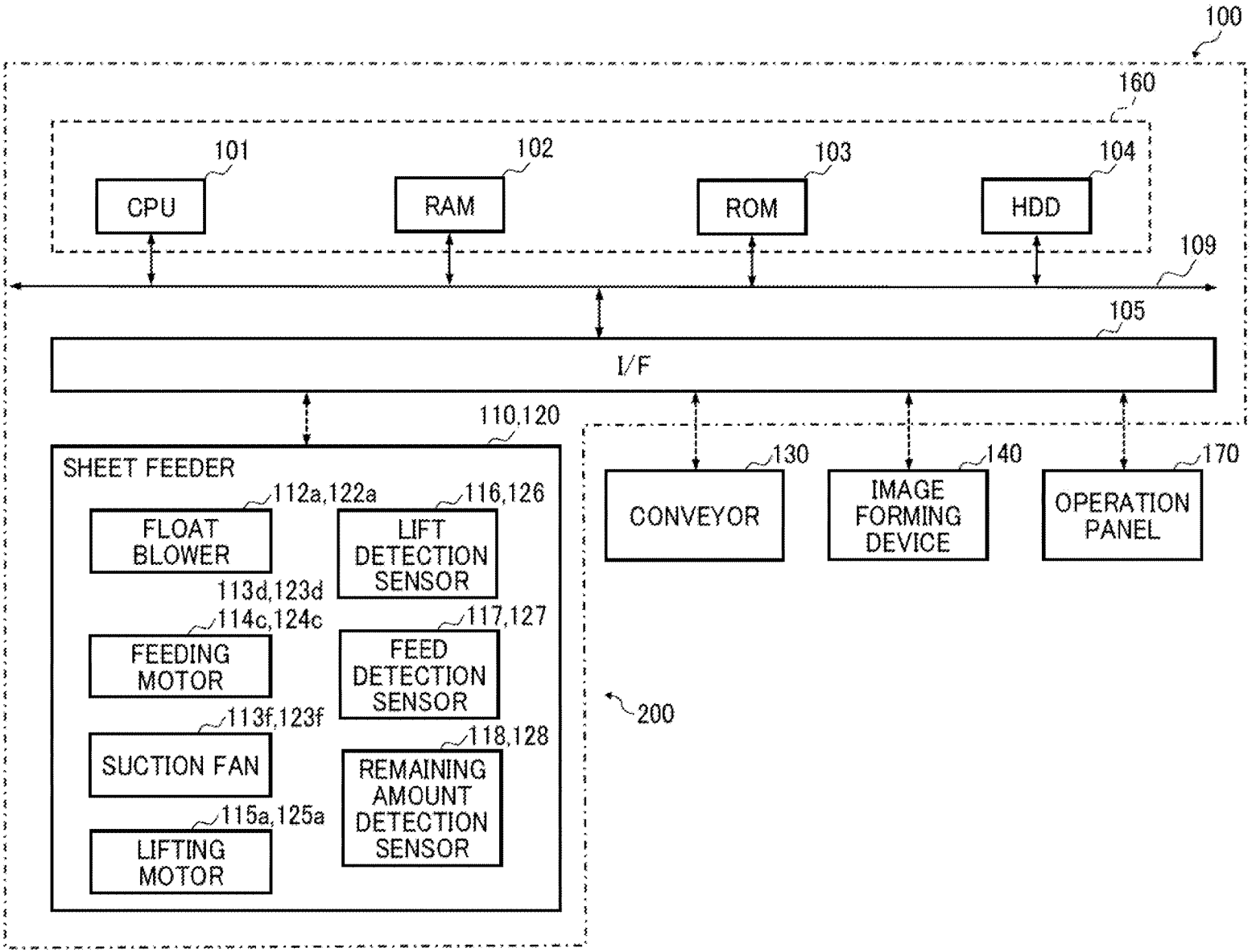
FIG. 4 is a functional block diagram illustrating a hardware configuration of the image forming apparatus of FIG. 1.

FIG. 4 is a functional block diagram illustrating a hardware configuration of the image forming apparatus 100, according to the present embodiment. The image forming apparatus 100 includes a central processing unit (CPU) 101 as a controller, a random access memory (RAM) 102 as a memory, a read only memory (ROM) 103 as a memory, a hard disk drive (HDD) 104 as a memory, and an interface (I/F) 105. The CPU 101, the RAM 102, the ROM 103, the HDD 104, and the I/F 105 are connected to each other via a common bus 109 as a communication member. The CPU 101, the RAM 102, the ROM 103, and the HDD 104 collectively serve as the controller 160.

The CPU 101 is an arithmetic unit and controls the entire operation of the image forming apparatus 100. The RAM 102 is a volatile storage medium capable of reading and writing data at high speed and is used as a work area when the CPU 101 processes the data. The ROM 103 is a read-only non-volatile storage medium in which programs such as firmware are stored. The HDD 104 is a large-capacity non-volatile storage medium capable of reading and writing data and stores, for example, an operating system (OS), various control programs, application programs.

The image forming apparatus 100 processes programs such as a control program stored in the ROM 103, a data-processing program, which is an application program, loaded from a storage medium such as the HDD 104 into the RAM 102, for example, by a calculation function of the CPU 101. A software controller that includes various functional modules of the image forming apparatus 100 is implemented by the above-described processing. A combination of the software controller as described above and the hardware resources installed in the image forming apparatus 100 serves as a functional block that implements the functions of the image forming apparatus 100.

The I/F 105 is an interface that connects the feeders 110 and 120, the conveyor 130, the image forming device 140, and an operation panel 170 to the common bus 109. In other words, the controller 160 controls the operations of the feeders 110 and 120, the conveyor 130, the image forming device 140, and the operation panel 170 through the I/F 105.

The operation panel 170 serves as a user interface that includes a display that displays, for example, current setting values and a selection screen and an operation device that includes, for example, a touch panel and a push button, that receives an input operation from a user.

As illustrated in FIG. 4, a sheet feeding apparatus 200 includes the feeders 110 and 120, the controller 160, the I/F 105, and the common bus 109. In other words, the above-described embodiment of the present disclosure can be applied not only to the image forming apparatus 100 but also to the sheet feeding apparatus 200 that is independent from the image forming apparatus 100.

Figure 5:
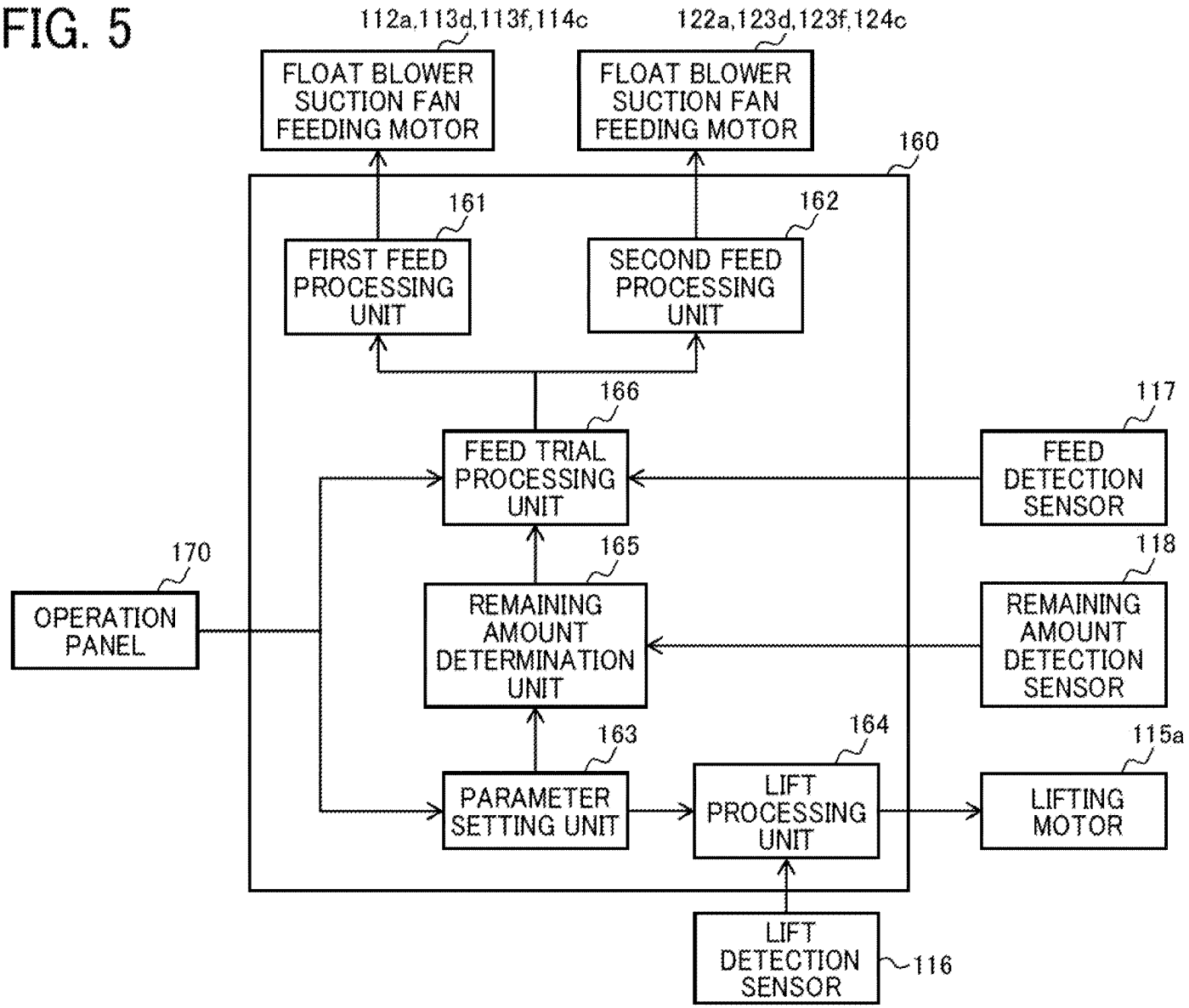
FIG. 5 is a functional block diagram illustrating components of a controller according to an embodiment of the present disclosure.

FIG. 5 is a functional block diagram illustrating, components of the controller 160, according to the present embodiment. The controller 160 typically includes a first feed processing unit 161, a second feed processing unit 162, a parameter setting unit 163, a lift processing unit 164, a remaining amount determination unit 165, and a feed trial processing unit 166. Each of the functional blocks that represents the first feed processing unit 161, the second feed processing unit 162, the parameter setting unit 163, the lift processing unit 164, the remaining amount determination unit 165, and the feed trial processing unit 166 included in the controller 160 is implemented, for example, by the CPU 101 that executes a program stored in a memory. Each of the functional blocks that represents the first feed processing unit 161, the second feed processing unit 162, the parameter setting unit 163, the lift processing unit 164, the remaining amount determination unit 165, and the feed trial processing unit 166 illustrated in FIG. 5 operates in conjunction with each other to feed a sheet M from one of the first feeder 110 or the second feeder 120 to the conveyance path R1.

The first feed processing unit 161 drives the float blower 112*a*, the suction fan 113*f*, and the feeding motors 113*d* and 114*c* to cause the first feeder 110 to perform the feeding operation illustrated in FIGS. 3A, 3B, and 3C. The second feed processing unit 162 drives a float blower 122*a*, a suction fan 123*f*, and feeding Motors 123*d* and 124*c* to cause the second feeder 120 to perform the feeding operation.

Figure 6:
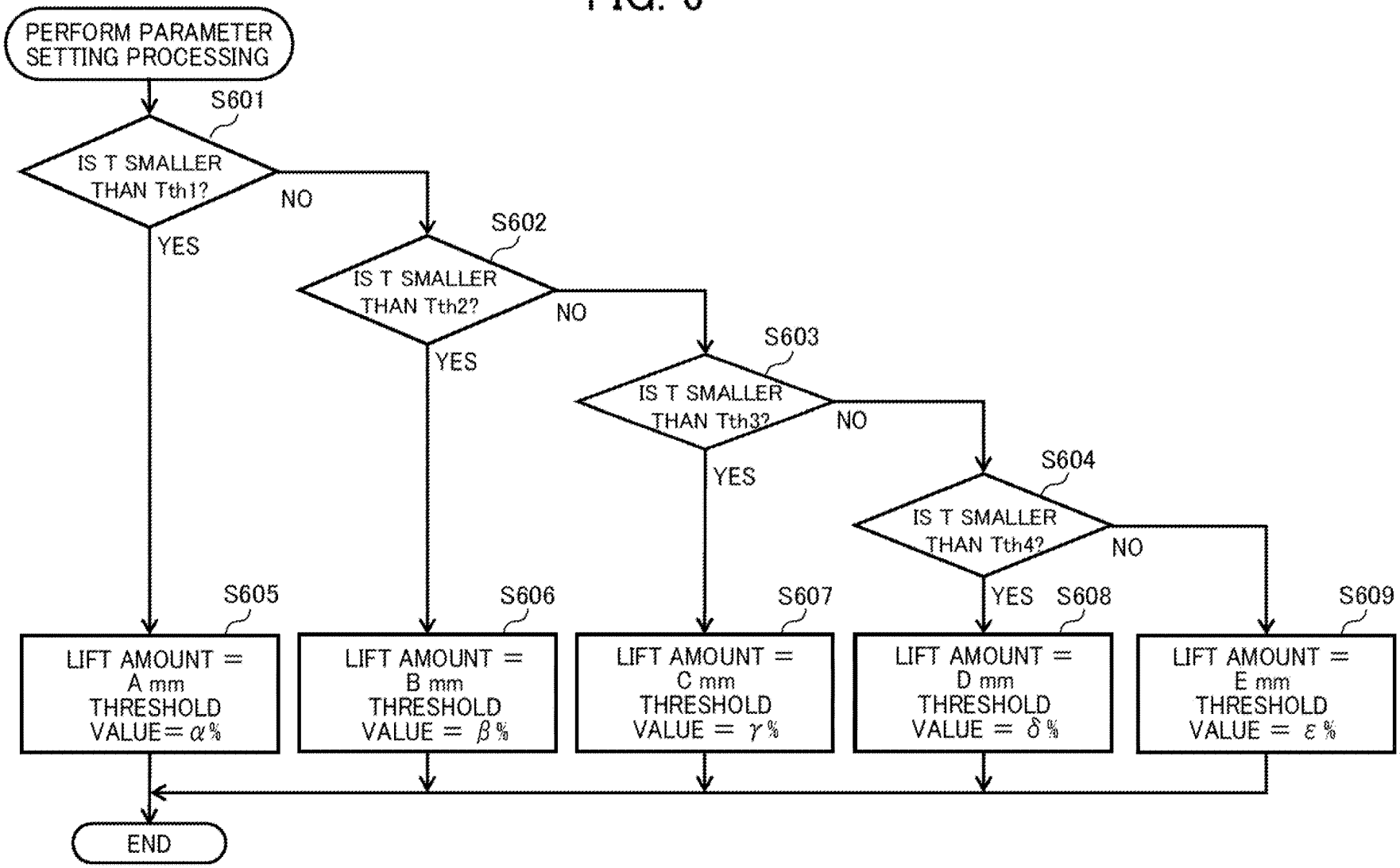
FIG. 6 is a flowchart illustrating parameter setting processing based on a thickness of a sheet, according to an embodiment of the present disclosure.
Figure 7:
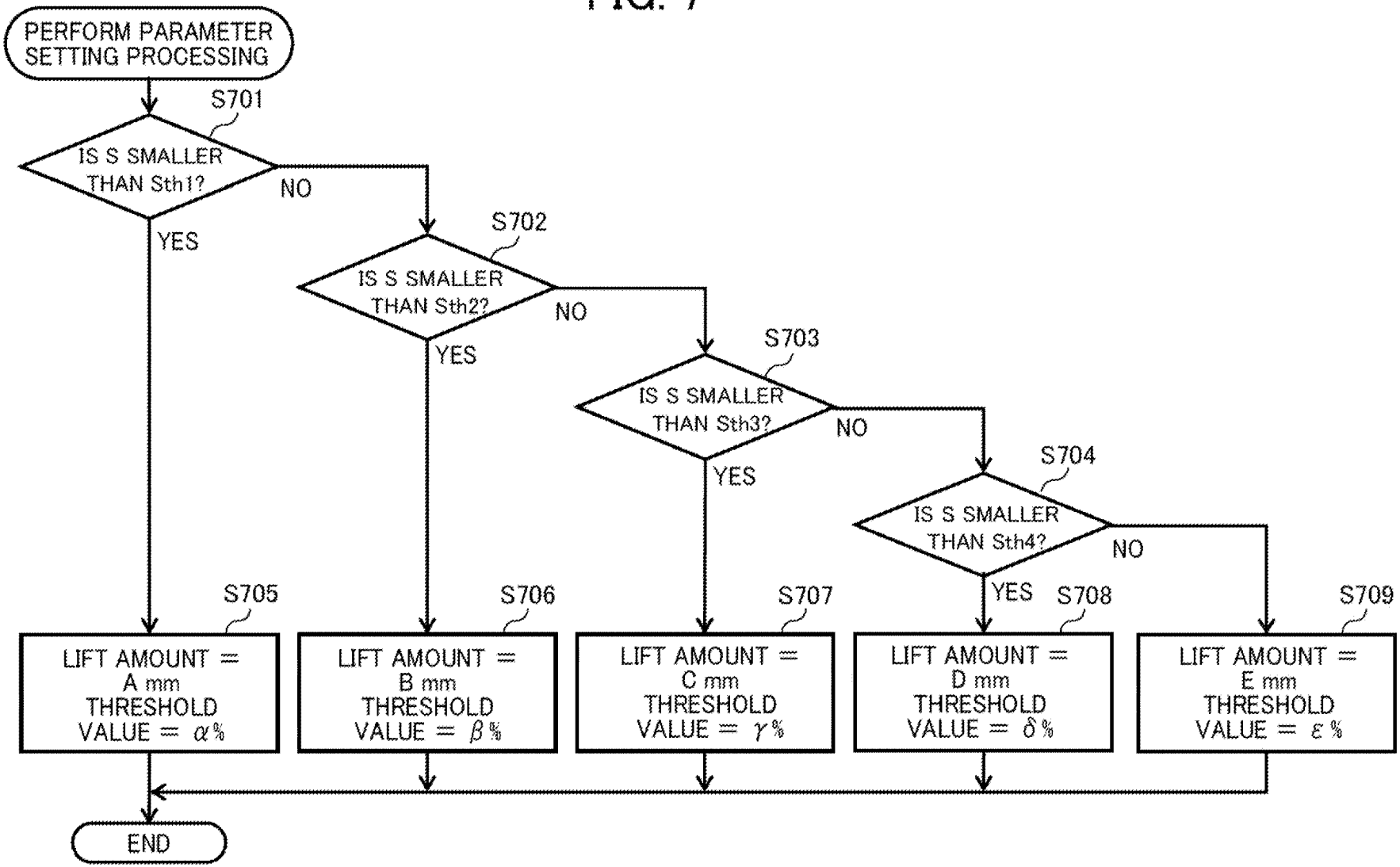
FIG. 7 is a flowchart illustrating parameter setting processing based on a size of a sheet, according to an embodiment of the present disclosure.
Figure 8:
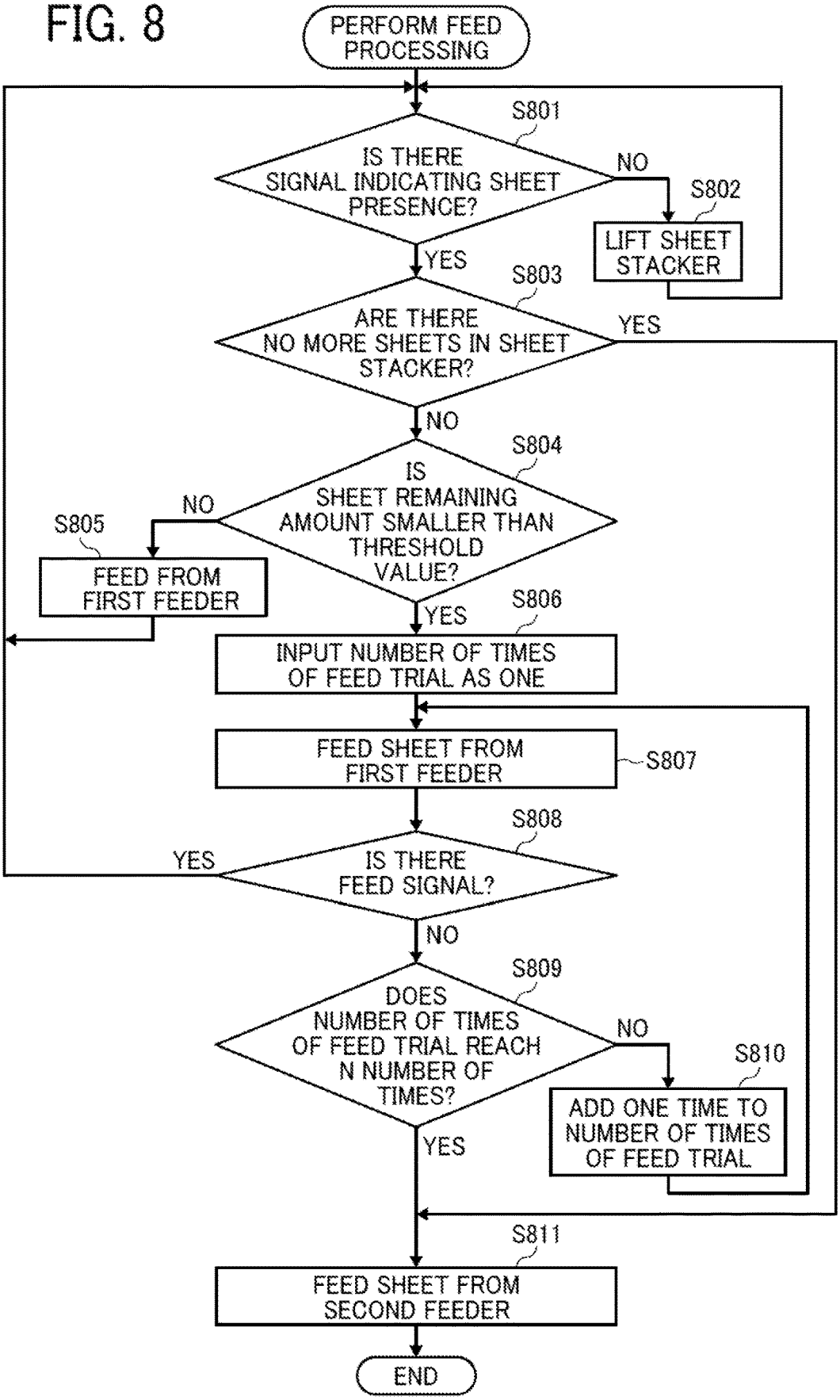
FIG. 8 is a flowchart of feed processing according to an embodiment of the present disclosure.
Figure 10:
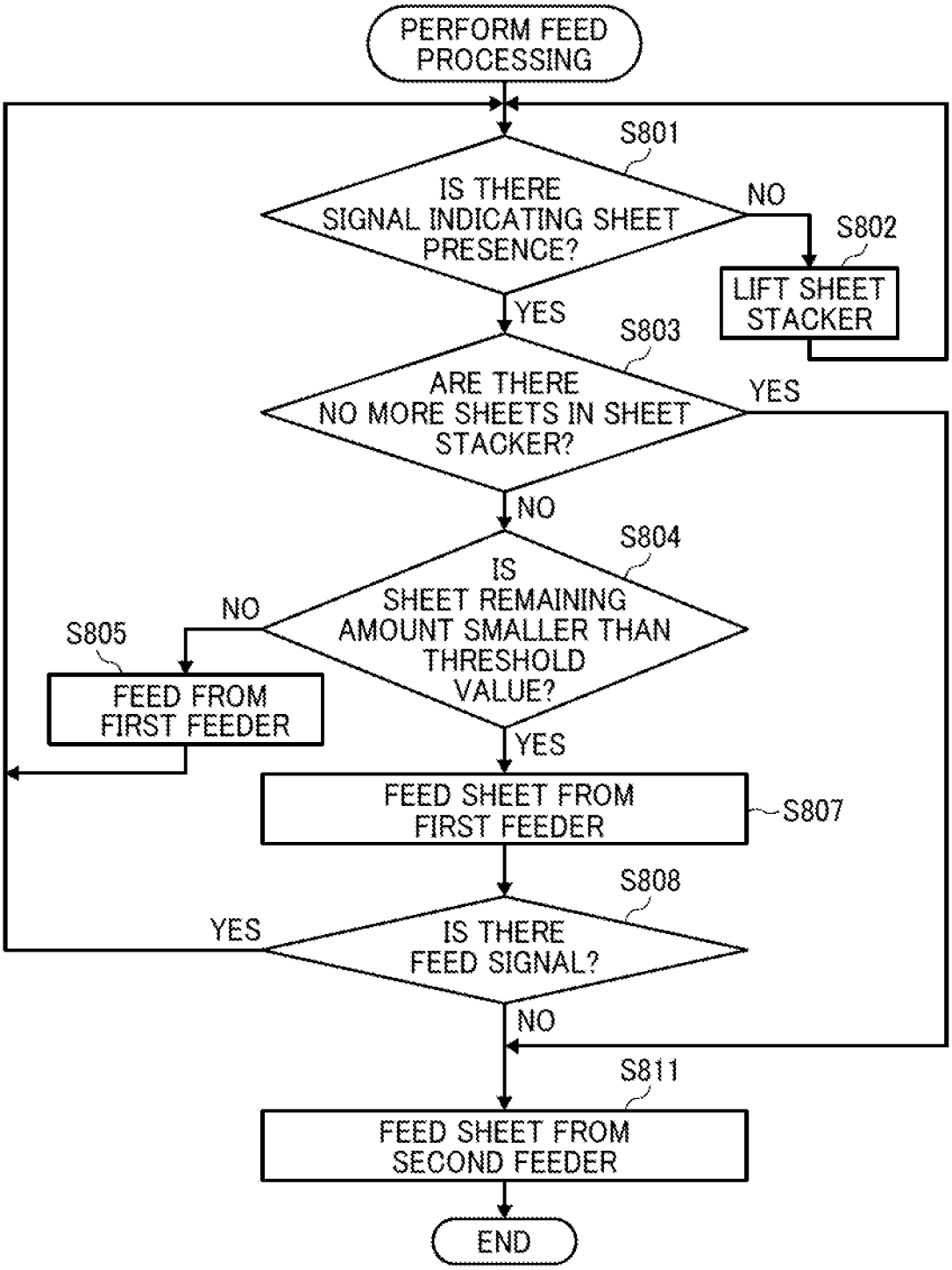
FIG. 10 is a flowchart illustrating a procedure of the feed processing according to a first modification of the feed processing of FIG. 8.
Figure 11:
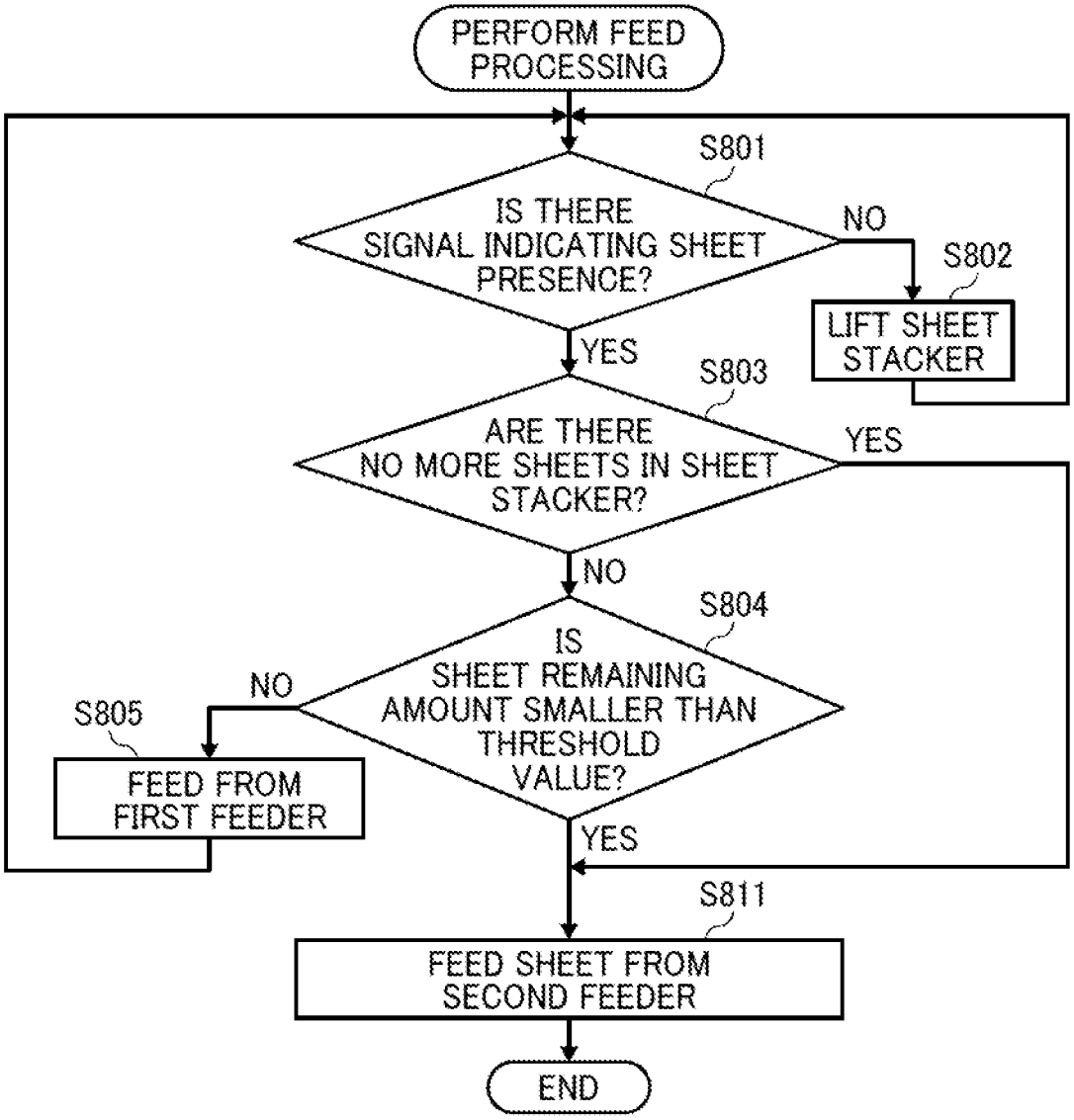
FIG. 11 is a flowchart illustrating a procedure of feed processing according to a second modification of the feed processing of FIG. 8.

The parameter setting unit 163 executes parameter setting processing illustrated in FIGS. 6 and 7 to set parameters such as a lift amount and a threshold, used in the feed processing illustrated in FIGS. 8, 10, and 11. The lift amount indicates a lift amount per one time of the sheet stacker 111. The threshold is a value to be compared with a remaining amount of sheets M on the sheet stacker 111 detected by the remaining amount detection sensor 118. In other words, the threshold is the remaining amount of sheets M when the sheet stacker 111 is lifted excessively and the air blown from the air blower 112 is blocked by the sheet stacker 111 and does not reach the sheets M. The processing of the parameter setting unit 163 is described later with reference to FIGS. 6 and 7.

The lift processing unit 164 causes the lifting mechanism 115 to lift the sheet stacker 111 based on the presence signal output from the lift detection sensor 116 and the lift amount set by the parameter setting unit 163. In addition, the lift processing unit 164 causes the lifting mechanism 115 to lower the sheet stacker 111 at a timing when the sheets M are replenished to the sheet stacker 111.

The remaining amount determination unit 165 determines the remaining amount of sheets M stacked on the sheet stacker 111 based on a pulse signal output from the remaining amount detection sensor 118 and the threshold set by the parameter setting unit 163. The remaining amount determination unit 165 integrates the number of pulse signals output from the remaining amount detection sensor 118. Then, the remaining amount determination unit 165 calculates the remaining amount of sheets M based on the integrated number of pulse signals. In other words, as the integrated number of the pulse signals increases, the remaining amount of sheets M decreases. Further, the remaining amount determination unit 165 resets the integrated number of pulse signals at a timing when the sheet stacker 111 is lowered by the lift processing unit 164.

The feed trial processing unit 166 causes the first feeder 110 to try the feeding operation based on an input operation of a user received through the operation panel 170, the remaining amount of sheets M determined by the remaining amount determination unit 165, and a feed signal output from the feed detection sensor 117. First, the feed trial processing unit 166 receives an input operation indicating whether to try the feeding operation of the first feeder 110 from a user through the operation panel 170. Then, after the feed trial processing unit 166 causes the first feeder 110 to try the feeding operation, the feed trial processing unit 166 determines whether the feeding operation has been normally completed based on whether a feed signal is output from the feed detection sensor 117. Further, the feed trial processing unit 166 causes the second feeder 120 to execute the feeding operation instead of the first feeder 110 in case where the feed sural is not output from the feed detection sensor 117 even when the first feeder 110 tries the feeding operation N times (N is an integer of two or more).

FIG. 6 is a flowchart of parameter setting processing based on a thickness T of the sheet M, according to an embodiment of the present disclosure. The parameter setting unit 163 acquires a thickness T (mm) of sheets M stacked on the sheet stacker 111. The parameter setting unit 163, for example, may acquire the thickness T by, for example, a sensor disposed in the sheet stacker 111 or the user's input through the operation panel 170. Next, the parameter setting unit 163 compares the acquired thickness T of the sheets M with predetermined thicknesses thresholds Tth1, Tth2, Tth3, and Tth4 (S601, S602, S603, and S604). Note that Tth1 is smaller than Tth2, Tth2 is smaller than Tth3, and Tth3 is smaller than Tth4 (Tth1<Tth2<Tth3<Tth4). Then, the parameter setting unit 163 sets the lift amount of the sheet stacker 111 and the threshold according to the thicknesses T of the sheets M stacked on the sheet stacker 111 (S605, S606, S607, S608, and S609).

More specifically, when the thickness T of the sheets M is smaller than the first reference threshold Tth1 (YES in S601), the parameter setting unit 163 sets the lift amount of the sheet stacker 111 to A mm and sets the threshold to α % (S605). When the thickness T of the sheets M is equal to or greater than the first threshold Tth1 and smaller than the second threshold Tth2 (YES in S602), the parameter setting unit 163 sets the lift amount of the sheet stacker 111 to B mm and sets the threshold to β % (S606). When the thickness T of the sheets M is equal to or greater than the second threshold Tth2 and smaller than the third threshold Tth3 (YES in S603), the parameter setting unit 163 sets the lift amount of the sheet stacker 111 to C mm and sets the threshold to γ % (S607). When the thickness T of the sheets M is equal to or greater than the third threshold thickness Tth3 and smaller than the fourth threshold thickness Tth4 (YES in S604), the parameter setting unit 163 sets the lift amount of the sheet stacker 111 to D mm and sets the thresholds to δ % (S608). Further, when the thickness T of the sheets M are equal to or greater than the fourth reference thickness Tth4 (NO in S604), the parameter setting unit 163 sets the lift amount of the sheet stacker 111 to E mm and sets the threshold to ε % (S609). Then, the parameter setting unit 163 notifies the lift processing unit 164 of the set lift amount of the sheet stacker 111 and notifies the remaining amount determination unit 165 of the set threshold.

FIG. 7 is a flowchart illustrating parameter setting processing based on a size, such as B4, A4, and letter size, of the sheet M, according to an embodiment of the present disclosure. The parameter setting unit 163 acquires a size S of the sheets M stacked on the sheet stacker 111. For example, the parameter setting unit 163 may acquire the size S by, for example, a sensor disposed in the sheet stacker 111 or the user's input through the operation panel 170. Next, the parameter setting unit 163 compares the acquired size S of the sheet M with predetermined threshold sizes Sth1, Sth2, Sth3, and Sth4 (S701, S702, S703, S704). Note that Sth1 is smaller than Sth2, Sth2 is smaller than Sth3, and Sth3 is smaller than Sth4 (Sth1<Sth2<Sth3<Sth4). Then, the parameter setting unit 163 sets the lift amount of the sheet stacker 111 and the threshold in accordance with the size S of the sheets M stacked on the sheet stacker 111 (S705, S706 S707, S708, S709).

More specifically, when the size S of the sheets M is smaller than the first threshold size Sth1 (YES in S701), the parameter setting unit 163 sets the lift amount of the sheet stacker 111 to A mm and sets the threshold to α % (S705). When the size S of the sheets M is equal to or larger than the first threshold size Sth1 and smaller than the second threshold size Sth2 (YES in S702), the parameter setting unit 163 sets the lift amount of the sheet stacker 111 to B mm and sets the threshold to β % (S706). When the size S of the sheets M is equal to or larger than the second threshold size Sth1 and smaller than the third threshold size Sth3 (YES in S703), the parameter setting unit 163 sets the lift amount of the sheet stacker 111 to C mm and sets the threshold to γ % (S707). When the size S of the sheets M is equal to or larger than the third threshold size Sth3 and smaller than the fourth threshold size Sth4 (YES in S704), the parameter setting unit 163 sets the lift amount of the sheet stacker 111 to D mm and sets the threshold to δ % (S708). Further, when the size S of the sheets M is equal to or larger than the fourth reference size Sth4 (NO in S704), the parameter setting unit 163 sets the lift amount of the sheet stacker 111 to E mm and sets the threshold to ε % (S709). Then, the parameter setting unit 163 notifies the lift processing unit 164 of the set lift amount of the sheet stacker 111 and notifies the remaining amount determination unit 165 of the set threshold.

In FIGS. 6 and 7, the lift amount of the sheet stacker 111 is set so that, for example, A is smaller than B, B is smaller than C, C is smaller than D, and D is smaller than. E (A<B <C<D<E). In other words, the larger the thickness T of the sheets M or the larger the size S of the sheets M, the parameter setting unit 163 increases the lift amount of the sheet stacker 111 per one time. In FIGS. 6 and 7, the threshold is set so that, for example, α is smaller than β, β is smaller than γ, γ is smaller than δ, and δ is smaller than ε(α<β<γ<δ<ε). In 5 other words, the larger the thickness T of the sheets M or the larger the size S of the sheets M, the parameter setting unit 163 increases the threshold to be compared with the remaining sheet amount of the sheets M. In the parameter setting processing of FIGS. 6 and 7, only one of the lift amount of the sheet stacker 111 and the threshold may be set or changed, and the other may be a predetermined fixed value.

Figure 9:
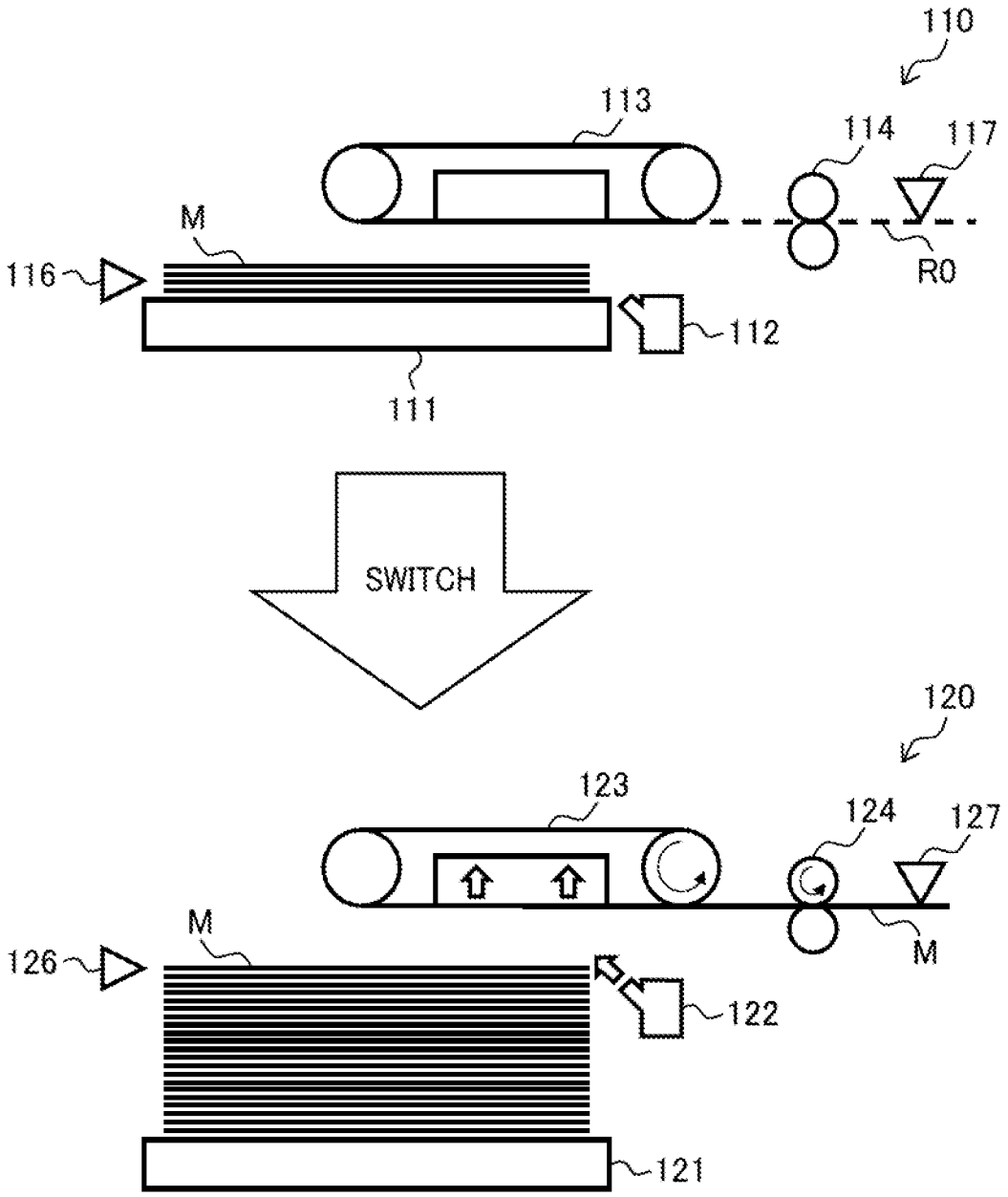
FIG. 9 is a schematic diagram illustrating the first feeder of FIG. 1 and a second feeder during the feed processing, according to an embodiment of the present disclosure.

FIG. 8 is a flowchart of the feed processing according to an embodiment of the present disclosure. FIG. 9 is a schematic diagram illustrating the feeders 110 and 120 during the feed processing, according to the present embodiment. The controller 160 executes the feed processing at a timing when an image formation instruction is input to the image forming apparatus 100. The feed processing is executed by the first feed processing unit 161, the second feed processing unit 162, the lift processing unit 164, the remaining amount determination unit 165, and the feed trial processing unit 166. On the other hand, the parameter setting processing by the parameter setting unit 163 is assumed to have been executed before the start of the feed processing.

First, the lift processing unit 164 determines whether a presence signal is output from the lift detection sensor 116, in other words, whether the sheet is detected by the lift detection sensor 116 (S801). When the presence signal is not output from the lift detection sensor 116 (NO in S801), the lift processing unit 164 rotates the lifting motor 115*a* in the first direction to lift the sheet stacker 111 by the lift amount set by the parameter setting unit 163 (S802), and executes the processing of step S801 again. In other words, the lift processing unit 164 lifts the sheet stacker 111 until the sheets M stacked on the sheet stacker 111 reach the detection position.

In response to the output of the presence signal from the lift detection sensor 116 (YES in S801), the lift processing unit 164 causes the remaining amount determination unit 165 to execute the processing in steps S803 and S804. Based on the integrated value of pulse signals output from the remaining amount detection sensor 118, the remaining amount determination unit 165 determines whether the sheets M are stacked on the sheet stacker 111 (S803) and Whether the remaining amount of sheets M on the sheet stacker 111 is smaller than the threshold set by the parameter setting unit 163 (S804).

When it is determined that the remaining amount of sheets M on the sheet stacker 111 is equal to or greater than the threshold (NO in S803 and NO in S804), the remaining amount determination unit 165 causes the first feed processing unit 161 to execute the processing of step S805. In step S805, the first feed processing unit 161 drives the float blower 112*a*, the suction fan 113*f*, and the feeding motors 113*d* and 114*c* to cause the first feeder 110 to execute the feeding operation. Accordingly, as illustrated in FIGS. 3A, 3B, and 3C, one sheet M is fed from the first feeder 110 to the conveyance path R1. Then, the first feed processing unit 161 causes the lift processing unit 164 to execute the processing of step S801.

In other words, the controller 160 causes the first feeder 110 to repeatedly execute the feeding operation (S805) during a period of time in which the remaining amount of sheets M on the sheet stacker 111 is equal to or greater than the threshold (No in S804) while lifting the sheet stacker 111 (S802). Accordingly, as illustrated in an upper part of FIG. 9, the amount of sheets M stacked on the sheet stacker 111 gradually decreases, and the sheet stacker 111 gradually elevates.

When the remaining amount determination unit 165 determines that the remaining amount of sheets M on the sheet stacker 111 is greater than 0% and smaller than the threshold (NO in S803 and YES in S804), the remaining amount determination unit 165 causes the feed trial processing unit 166 to execute the processing of step S806. The feed trial processing unit 166 substitutes one for the number of feed trials stored in the RAM 102 or the HDD 104 (S806), and causes the first feed processing unit 161 to execute the processing of step S807.

In step S807, the first feed processing unit 161 drives the float blower 112*a*, the suction fan 113*f*, and the feeding motors 113*d* and 114*c* to cause the first feeder 110 to execute the feeding operation. In other words, when the controller 160 determines that the remaining amount of sheets M on the sheet stacker 111 is smaller than the threshold (NO in S804), the controller 160 causes the first feeder 110 to try the feeding operation (S807). Then, the first feed processing unit 161 causes the feed trial processing unit 166 to execute the processing of step S808.

The feed trial processing unit 166 determines whether the feed signal is output from the feed detection sensor 117 (S808). In other words, the feed trial processing unit 166 determines whether the sheet M is fed to the conveyance path R1 by the feeding operation tried by the first feeder 110 in step S807 (S808). When the feed trial processing unit 166 determines that the feed signal is output from the feed detection sensor 117 (YES in S808), the feed trial processing unit 166 causes the lift processing unit 164 to execute the processing of step S801.

On the other hand, when the feed trial processing unit 166 determines that the feed signal is not output from the feed detection sensor 117 (NO in S808), the feed trial processing unit 166 determines whether the number of feed trials has reached N times (S809). When the feed trial processing unit 166 determines that the number of feed trials is smaller than N times (NO in S809), the feed trial processing unit 166 adds one to the number of feed trials (S810) and causes the first feed processing unit 161 to execute the processing of step S807. In other words, the controller 160 causes the first feeder 110 to try the feeding operation N times at the maximum until the feed signal is output from the feed detection sensor 117 (S806, S807, S808, S809, S810).

When the feed trial processing unit 166 determines that the number of feed trials has reached N times (YES in S809), the feed trial processing unit 166 causes the second feed processing unit 162 to execute the processing of step S811, In step S811, the second feed processing unit 162 drives the float blower 122*a*, the suction fan 123*f*, and the feeding motors 123*d* and 124*c* to cause the second feeder 120 to execute the feeding operation. In other words, when the feed signal is not output from the feed detection sensor 117 even if the first feeder 110 tries the feeding operation N times (NO in S808 and YES in S809), the controller 160 causes the second feeder 120 to feed a sheet M instead of the first feeder 110 as illustrated in FIG. 9 (S811).

In addition, when the remaining amount determination unit 165 determines that sheets M are not stacked on the sheet stacker 111 (YES in S803), the remaining amount determination unit 165 causes the second feed processing unit 162 to execute the processing of step S811 without executing steps S804, S805, S806, S807, S808, S809, and S810. Further, the remaining amount determination unit 165 may notify the user that the sheets M are not stacked on the sheet stacker 111 through the operation panel 170.

According to the above-described embodiment, for example, the following functional effects are achieved.

According to the above-described embodiments, when the remaining amount of sheets M on the sheet stacker 111 is smaller than the threshold (YES in S804), the controller 160 causes the second feeder 120 to execute the feeding operation instead of the first feeder 110 (S811). Accordingly, in a case in which the sheet stacker 111 approaches the endless annular belt 113*c* and air blown from the air blower 112 is unlikely to reach an uppermost sheet M, the feeding operation is switched so that the second feeder 120, instead of the first feeder 110, executes the feeding operation. Accordingly, the operation rate of the image forming apparatus 100 and the sheet feeding apparatus 200 can be enhanced. On the other hand, when the remaining amount of sheets M on the sheet stacker 111 is equal to or greater than the threshold (NO in S804), the controller 160 causes the first feeder 110 to execute the feeding operation (S805). Accordingly, replenishing the sheet M at an unnecessary timing by a user can be prevented.

According to the above-described embodiment, when the remaining amount of sheets M on the sheet stacker 111 is smaller than the threshold (YES in S804), the controller 160 causes the first feeder 110 to try the feeding operation N times at the maximum (S806, S807, S808, S809, S810). Accordingly, the feeding operation can be switched so that the second feeder 120, instead of the first feeder 110, executes the feeding operation after the sheets M stacked on the sheet stacker 111 are consumed as much as possible. Accordingly, replenishing the sheet M at an unnecessary timing by a user can be further prevented. Note that the maximum number of feed trials N may be a predetermined fixed value or may be set by the user through the operation panel 170.

In addition, according to the above-described embodiment, the rotary encoder attached to the lifting motor 115*a* is Used as the remaining amount detection sensor 118. For this reason, the number of components of the image forming apparatus 100 can be reduced as compared with a case in which the remaining amount detection sensor 118 is disposed separately from the rotary encoder.

Further, according to the above-described embodiment, the lift amount of the sheet stacker 111 and the threshold are variable in accordance with the thickness T or the size S of the sheets M. Accordingly, an appropriate lift amount of the sheet stacker 111 and an appropriate threshold in accordance with the type of the sheet M can be used. However, the lift amount of the sheet stacker 111 and the threshold may be predetermined fixed values or may be set by the user through the operation panel 170.

First Modification

Feed processing according to a first modification of the feed processing of FIG. 8 is described with reference to FIG. 10. FIG. 10 is a flowchart illustrating a procedure of the feed processing according to the first modification. A detailed description of points that are similar to the above-described embodiment is omitted, and points that are different from the above-described embodiment are mainly described. The feed processing illustrated in FIG. 10 is different from the feed processing illustrated in FIG. 8 in that steps S806, S809, and S810 are omitted in the feed processing of FIG. 10.

When it is determined that the remaining amount of sheets M on the sheet stacker 111 is smaller than the threshold (YES in S804), the controller 160 according to the first modification causes the first feeder 110 to try the feeding operation only once (S807). Then, when it is determined that the feed signal is not output from the feed detection sensor 117 (NO in S808), the controller 160 causes the second feeder 120 to feed the sheet instead of the first feeder 110 (S811).

Second Modification

Feed processing according to a second modification is described with reference to FIG. 11. FIG. 11 is a flowchart illustrating a procedure of feed processing according to the second modification. A detailed description of points that are similar to the above-described embodiment is omitted, and points that are different from the above-described embodiment are mainly described. The feed processing illustrated in FIG. 11 is different from the feed processing illustrated in FIG. 8 in that steps S806, S807, S808, S809, and S810 are omitted in the feed processing of FIG. 11.

In the second modification, when the remaining amount of sheets M on the sheet stacker 111 is determined to be smaller than the threshold (YES in S804 the controller 160 causes the second feeder 120 to feed the Sheets without causing the first feeder 110 to try the feeding operation (S811). In other words, in the second Modification, the feed trial processing unit 166 is omitted.

According to the second modification, in a case in which the sheet stacker 111 is lifted excessively and the feeding operation by the first feeder 110 is highly likely to fail (YES in S804), the controller 160 causes the second feeder 120 to feed the sheets M without causing the first feeder 110 to try the feeding operation (S811). Accordingly, a time loss in the feed processing can be reduced.

Note that the controller 160 may switch between the feed processing illustrated in FIG. 8 or 10, which causes the first feeder 110 to try the feeding operation, and the feed processing illustrated in FIG. 11, which causes the second feeder 120 to feed sheets M without causing the first feeder 110 to try the feeding operation, according to an input operation received through the operation panel 170. Such a configuration as described above allows the feed trials of the feeding operation performed by the first feeder 110 to switch between valid and invalid in accordance with the use environment of the user.

Each of the functions according to the embodiments described above can be implemented by one processing circuit or multiple processing circuits. In the above-described embodiments of the present disclosure, the processing circuit includes a processor programmed to execute each function by software such as a processor implemented by an electronic circuit, and a device such as an application specific integrated circuit (ASIC), a digital signal processor (DSP), a field programmable gate array (FPGA), or a conventional circuit module designed to execute each function described above.

Note that the present disclosure is not limited to specific embodiments described above, and numerous additional modifications and variations are possible in light of the teachings within the technical scope of the appended claims. It is therefore to be understood that the disclosure of the present specification may be practiced otherwise by those skilled in the art than as specifically described herein. Such embodiments and modifications thereof are included in the scope and gist of the embodiments of the present disclosure and are included in the embodiments described in claims and the equivalent scope thereof.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

The invention claimed is:

1. A sheet feeding apparatus comprising:

a first feeder configured to float and feed a sheet;

a second feeder configured to feed a sheet; and processing circuitry configured to cause the first feeder and the second feeder to feed a sheet, wherein the first feeder includes:

a sheet stacker on which a plurality of sheets are stacked in a stacked state;

an air blower configured to blow air from a lateral side of the plurality of sheets stacked on the sheet stacker to float an uppermost sheet;

a suction feeder above the sheet stacker, configured to suck a sheet floated by the air blower and feed the sheet in a feed direction;

a remaining amount detection sensor configured to detect a remaining amount of sheets stacked on the sheet stacker; and a feed detection sensor configured to detect the sheet fed by the suction feeder, wherein the processing circuitry is configured to:

determine whether the remaining amount of sheets in the first feeder is smaller than a threshold;

cause the first feeder to perform a feeding operation of feeding the sheet floated by the air blower to the suction feeder in response to a determination that the remaining amount of sheets in the first feeder is equal to or greater than the threshold;

cause the first feeder to try the feeding operation in response to a determination that the remaining amount of sheets in the first feeder is smaller than the threshold; and cause the second feeder to feed the sheet instead of the first feeder in response to a detection of absence of a sheet by the feed detection sensor.

2. The sheet feeding apparatus according to claim 1, wherein the processing circuitry is configured to:

cause the first feeder to try the feeding operation N times at maximum, where N is an integer equal to or greater than two, until a sheet is detected by the feed detection sensor in response to the determination that the remaining amount of sheets in the first feeder is smaller than the threshold; and cause the second feeder to feed the sheet instead of the first feeder in response to the detection of absence of a sheet by the feed detection sensor even when the first feeder performs the feeding operation N times.

3. The sheet feeding apparatus according to claim 1, further comprising an operation device configured to receive an input operation of a user, wherein the processing circuitry is configured to switch between causing the first feeder to try the feeding operation and causing the second feeder to feed a sheet without causing the first feeder to try the feeding operation, according to the input operation received through the operation device, in a case where the processing circuitry determines that the remaining amount of sheets in the first feeder is smaller than the threshold.

4. The sheet feeding apparatus according to claim 1, wherein the first feeder includes:

a lifting motor configured to lift the sheet stacker; and a lift detection sensor configured to detect presence of a sheet stacked on the sheet stacker at a detection position between the sheet stacker and the suction feeder, wherein the processing circuitry is configured to cause the lifting motor to lift the sheet stacker in response to detection of absence of a sheet by the lift detection sensor, and wherein the remaining amount detection sensor is a rotary encoder configured to output a pulse signal corresponding to a rotation amount of the lifting motor to the processing circuitry.

5. The sheet feeding apparatus according to claim 4, wherein the processing circuitry is configured to change a lift amount per one time of the sheet stacker by the lifting motor in accordance with a thickness or a size of sheets stacked on the sheet stacker.

6. The sheet feeding apparatus according to claim 1, wherein the processing circuitry is configured to change the threshold in accordance with a thickness or a size of sheets stacked on the sheet stacker.

7. An image forming apparatus comprising:

the sheet feeding apparatus according to claim 1; and an image forming device configured to form an image on a sheet fed by the sheet feeding apparatus.

* * * * *